US006554544B1

(12) United States Patent
Barkász

(10) Patent No.: US 6,554,544 B1
(45) Date of Patent: Apr. 29, 2003

(54) METHOD TO BUILD A WATER SEAL, CREEP-LINE INCREASING CUTOFF

(76) Inventor: Sándor Barkász, Száanth´´Albert u. 20, H-5630 Békés (HU)

( * ) Notice: Subject to any disclaimer, the term of this patent is extended or adjusted under 35 U.S.C. 154(b) by 0 days.

(21) Appl. No.: 09/979,938

(22) PCT Filed: Feb. 4, 2000

(86) PCT No.: PCT/HU00/00010

§ 371 (c)(1),
(2), (4) Date: Nov. 28, 2001

(87) PCT Pub. No.: WO00/47827

PCT Pub. Date: Aug. 17, 2000

(30) Foreign Application Priority Data

Feb. 10, 1999 (HU) ..... 9900291

(51) Int. Cl.[7] ..... E02D 5/02

(52) U.S. Cl. ..... 405/274; 405/267; 405/283; 405/302.4

(58) Field of Search ..... 405/274, 267, 405/283, 302.4

(56) References Cited

U.S. PATENT DOCUMENTS 3,851,478 A * 12/1974 Ayres ..... 405/267
4,304,507 A 12/1981 Sato

FOREIGN PATENT DOCUMENTS

| | | | |
|---|---|---|---|
| DE | 10 60 329 | 6/1959 | |
| DE | 34 36 735 | 4/1986 | |
| DE | 34 44 682 | 9/1986 | |
| DE | 38 23 784 | 1/1990 | |
| EP | 0 298 283 | 1/1989 | |
| EP | 0 333 639 | 9/1989 | |
| GB | 2 250 766 | 6/1992 | |
| HU | 167 865 | 12/1975 | |
| HU | 169 315 | 7/1977 | |
| HU | 181 284 | 2/1985 | |
| HU | 205 177 | 8/1989 | |
| HU | 4724/84 | 5/1992 | |
| HU | 217 308 | 12/1999 | |
| JP | 409209367 A * | 8/1997 | ..... E02D/19/12 |

* cited by examiner

*Primary Examiner*—J. J. Swann
*Assistant Examiner*—Katherine Mitchell
(74) *Attorney, Agent, or Firm*—Venable; Robert Kinberg; Catherine M. Voorhees

(57) ABSTRACT

A method for building a continuous water seal, creep line increasing cutoff includes the steps of forming spaced borings into the soil in the presence of slurry; developing narrow slots between the formed borings by driving foil boards with cutting edges secured to the bottom therof between adjacent formed borings; and connecting adjacent foil board, which extend between and are recessed into a side of the borings, by means of compensating joint-pins. The steps of developing narrow slots and connecting adjacent foil boards are repeated so that the last boring is connected to the connected, recessecd foil boards forming the cutoff. A prefered embodiment of the invention may include armoring the borings by injecting concrete in the place of the slurry.

10 Claims, 5 Drawing Sheets

METHOD TO BUILD A WATER SEAL, CREEP-LINE INCREASING CUTOFF

TECHNICAL FIELD

The present invention relates to a method to build a continuous, water seal, creep-line increasing cutoff (wall), in which borings have predetermined distances therebetween and foil boards will be formed in the soil, according to the length of the cutoff and under protection of slurry.

The method comprises a first step in forming borings into the soil under protection of slurry and developing narrow slots therebetween by blowing the cutting edge secured to the bottom of foil boards, and a second step of connecting the connecting elements of foil boards recessed into the borings by means of compensating joint-pins and repeating the latter operation up to the last boring. In a preferred embodiment of the invention, armor may be set into the borings, which are then injected with concrete in the place of the slurry.

The present invention enables a cutoff to be effectively built, without the need of trenching, such a cutoff will have a creep-line increasing behavior depending on its distance to the confining bed, and a load-bearing characteristic, because of its facet-like arrangement.

BACKGROUND ART

The presently known methods of cutoff building appeared and started to spread in the early fifties—in the mid-sixties in Hungary—, since their application for sheeting and bracing of a building pit, or building of underground structures (e.g., basements), as well as for water seal objects is more advantageous than the different conventional technologies. downwardly from the surface, then constructing the structure out of the slurry simultaneously or subsequently from the gap.

The cutoff building technology is determined by the behavior of the applied machines. Every machine which is acceptable of building a continuous, load-bearing and/or water seal wall by building-in of suitable materials in a depth beneath its moving plane, will be applicable to build such a cutoff.

Altogether, the cutting action—but always in case of large cuttings—involves two basic steps: excavating the soil and filling the gap.

It is possible to draw a distinction between applicable technologies according to the method of how the soil structure being in the place of the material of the wall volume is removed (carried away, respectively). Accordingly, two primary methods are known:

The ditcher applying technology has two essential characteristics, namely

- the soil mellowing by the cutting tool of the ditch might be excavating from the gap to the surface by the vertical movement of the tool controlled from the ditcher.
- during the excavation, the slush filling the gap might be mixed due only to the upward and downward movements of the tool.

Applying the drilling methods, only mellowing and braying of the soil are made by the cutting tool (borer, cutter, cutterhead).

The mellowed solid material admixed to the slush being in circulation is removed to the surface in form of slurry. (After backing and cleaning of the slurry, the slush is fed back into the gap.) The slush acts in this technology as an agent enhancing the stability of the gap and also excavating the solid material. This method for building a cutoff had been developed from the so-called 'left-flushing' (back-flushing) drilling technology and the appearance of bentonite suspensions having tixothrope characteristics—as a drilling slush or cutting sludge—had had a role of vital concernment.

The aforementioned methods working with soil excavation are applicable to form wide gaps, but a narrower cutoff can be formed by compaction to the side wall of the gap, ergo without excavation of the soil. Among these methods, there is the ETF method and its developed variants having a practical relevance.

This method—in substance—comprises a first step of longitudinally attaching injecting tubes to a high-webbed double-tee beam (or to a cutting tool having any kind of other profile), then hammering it down by machine to a depth according to the cutoff being built, and a further step of grouting contemporaneously the beginning of the cutter-flitting with an afterhardening bonding material passing through the tube (tubes) into the gap. After the solidification of the bonding material, a cutoff block is formed. Patent description HU P 94 03 231 relates to a preferred implementing of the injection and a composition of injected material(s).

The continuous cutoff consists of cutoff blocks being formed one after another, the continuity of which is established with a so called 'cutting back' action. Applying two cutting tools at the same time with the second one remaining in the soil as long as it takes for the gap of the first one to become fully injected. This technology can be advantageously achieved also by a cutting tool disclosed in the granted patent HU 167 865.

Disadvantages of these known methods are the laborsome and slow building process, and that fact, that the complete cutoff (membrane wall) has a diminished water sealing or bleeding decreasing only, not to be loaded and it can be built into a shallow depth only.

A structural embodiment of the cutoff-structures realized in the wide cuttings depends on the scope of the cutoff (whether it should be bleeding decreasing and/or load bearing too).

In some cases, the slush enabling the stability of the cutoff should act as a part of the final structure. Such a cutoff and gap filling material (cement, water, bentonite and retarding agent) are known from the patent description HU 181284.

HU 169 315 discloses a method in which prefabricated wall members are sunk into the gap sustained by a thin-liquid slurry, then the gap will be formed between the wall members and the walls of the gap shall be filled with afterhardening binder material injected into the bottom of the cutting.

In the case of concrete walls prepared in wide gaps, the continuous cutoff is typically built from sections. Such a method can be known from the patent description HU P 84 4727, this method involves a step of building a concrete wall in any section of the cutting, and a second step of locating a recoverable spacing member between this section and the cutting sustained provisionally by thin-liquid slurry, and the continuous water sealing contact is provided by a resilient, permanently located water-proof strip.

The structure and building method of a boarded-panel type cutoff comprising bearing board and sealing board is known from the patent EP 0 333 639, in which the place of the bearing boards (tubes made from steel) filled and surrounded by concrete, is made by drilling technology.

The cutoff described in the patent U.S. Pat. No. 4,304,507 is able to bear considerable loadings. The building of this cutoff takes place by making borings in predetermined distances from one another, then locating a steel beam of H shaped profile in the borings, and then excavating the place of cutoff boards by means of a pressurized water beam.

The cutoff described in the patent U.S. Pat. No. 4,304,507 is able to bear considerable loadings. The building of this cutoff takes place by making borings in predetermined distances from one another, then locating a steel beam of H shaped profile in the borings, and then excavating the place of cutoff boards by means of a pressurized water beam.

In cases obtaining greater impermeability (or bleeding decreasing), secondary sealing devices are applicable in the tixothrope or afterhardening (hardening) material filling the wide cutting.

The provisional publication DE OS 3436 735 discloses a solution, in which a plane type barrier layer interlaced with connecting elements and embedded into a wide cutting filled with suspension and having barrier element consisting of HDPE is formed.

The patent description EP O 298 283 discloses method, in which a barrier wall made of glass panels is provided and embedded into the slush of the gap. In this patent, the inner cavities of connecting links of the wall are filled by the slush.

From Hungarian published patent HU 205 177 is known a method, in which the foil sheets provided with connecting links at the edges thereof are sunk into the gap by the force exerted to the bottom part of the foil sheet (to ensure the closure of the connecting members), and thereafter a fusible material should be filled between the foil and the walls of the gap.

In the provisional publication DE OS 34 44 682, another solution is suggested, in which the wide gap is filled with a hardening sealing compound, then a narrow gap should be formed mechanically or by means of compressed water beam, and the barrier foil is placed therein.

According to a developed solution of the latter, disclosed in the patent disclosure DE 38 23 784, borings are provided in the mass filling the wide gap and posts of a slitting cutter device are guided into the borings so forming (feeding supporting liquid contemporaneously) the narrow It can be seen from the aforementioned solutions, that each of these known methods require a time consuming and expensive soil excavation.

The methods applicable without excavation of the soil have a serious depth confinement due to the enormous friction force action between the cutting tool and the wall of the gap. In addition, the injected cutoff created this way is a lesser water-proof one (and barely loadable).

SUMMARY OF THE INVENTION

It is an object of the present invention to provide a curtain-wall, which could be built almost up to the depth measure of known cutoffs, the cutoff according to the present invention could have a good water-proof characteristic, low production costs and a short production time compared to the known solutions.

We have found that the trenchless grouting technologies combined with drilling methods are able to sink into the soil plane type sealing elements and open the narrow gap contemporaneously so that the cutoffs in progress intersect the inner space of the borings filled with slush already prepared. In this case, the side friction acting to the side walls of the sealing element will be decreased due to the slush flowing from the borings into the opening gap thereby affording an opportunity to contact the sealing element in a stress-free and water-proof way and to create a continuous cutoff.

According to this fact, the present invention relates to a method to build a continuous cutoff, in which borings having predetermined distances therebetween and foil boards having a cutting edge will be driven into the soil, according to the length of the cutoff and under the protection of slurry. The cutting edge protruding over the edges of the foil boards is secured onto the bottom of the foil boards and provided with connecting members that are well known in the art, and then the foil board is hammered down into the soil up to the desired depth by means of driving piles driven by adjacent borings and placed onto each end of the cutting edge of the foil board, and after the hammering down of a subsequent foil board, the edges of the foil boards are connected into space of the intermediate boring by means of a compensating joint-pin. These operations are repeated along the full length of the cutoff.

In a preferred embodiment of the method according to the invention, above the surface of the soil, the two driving piles working in the same stroke will be rigidly connected to each other and hammered down together.

Advantageously, in the method according to the invention, the foil boards consist of High Density Polyethylene (HDPE) material.

The compensating joint-pins connecting the foil boards are foil strips advantageously made of the same material, and having connecting members creating a form-fitting pair at their edges connecting to the connecting members of the foil boards.

In a more preferred embodiment of the method according to the invention, an armoring step that is well known in itself in the art may place armor into the borings, and the compensating joint-pins include bridles provided with connecting members, and a volume of concrete displaces the slurry that may be injected into the bottom of the armored borings.

Advantageously, the applied driving piles include inner ribs and cross-ribs forming a skirt, each cross-rib being arranged to span two opposite quadrants of a driving pile, and having a face formed by ends of the inner-ribs which converges to the centreline of the driving pile.

In a preferred embodiment of the method according to the invention, the driving pile includes a number of sections detachably jointed to each other, and the inner-ribs of the driving pile include hollowed sheets incurvated to arc at their edges.

BRIEF DESCRIPTION OF THE DRAWINGS

The present invention will now be described, by way of example, with reference to the accompanying drawings, in which.

DETAILED DESCRIPTION OF THE INVENTION

FIG. 1.*a* shows, the steps of the method according to the invention. The first step consists of forming borings $\mathbf{2}_1$, $\mathbf{2}_2$, $\mathbf{2}_3$, . . . $\mathbf{2}_{n+1}$ at predetermined distances from one another in the soil 1. The forming of borings take place in a known way, under the protection of a slurry, e.g., tixothrope slush, that fills the borings $2_1$, $2_2$, $2_3$, . . . $2_{n+1}$.

The next step is the trenchless completion of a narrow gap intersecting the inner space of the adjacent borings $2_1$, $2_2$.

During the method, the foil board $4_1$ being driven into the narrow gap $3_1$ will be placed in the presence of slurry flowing from the boring $2_1$, $2_2$ to the narrow gap $3_1$, and the opening of the gap $3_1$ also takes place at the same time.

Mention must be made of the need to refill the slush leaking off during the creation of the cutoff board.

In the FIG. 1.*b* connecting members 5*a*, 5*b* attached to the edges of the foil board $4_1$ are shown. These connecting members 5*a*, 5*b* attached to the edges of the foil board $4_1$ are shown. These connecting members 5*a*, 5*b* are equally shaped, bar-like elements, in this case.

FIG. 1.*c* shows the following step of the method of the invention, in which a second narrow gap $3_2$ receiving a foil board $4_2$ is provided.

As can be seen in the FIG. 1.*d*, the foil boards $4_1$, $4_2$ hammered down into the soil 1 are connected inside of the boring $2_2$ by means of compensating joint-pins $6_1$ and connecting members 7*a*,7*b* thereof. The compensating joint-pins $6_1$, comprises a foil strip having hollowed connecting members 7*a*,7*b*—like the 5*a*,5*b* connecting members—adjacent to its edges.

One does not find any difficulty in driving the compensating joint-pin $6_1$ into the boring $2_2$, because the operation can be easily accomplished in the material having a tixothrope characteristic. In addition, there is no danger of becoming stuck, since the dimensional deviation arising from the biased boring $2_n$, . . . $2_{n+1}$ or from the untruth of alignment of the edges of the foil boards $4_1$ . . . $4_n$, by means of the compensating joint-pin $6_1$, having greater wideness than the distance of the edges of adequately flexible foil boards $4_1$ . . . $4_n$, could be easily corrected.

FIG. 1.*e* shows the following step of the method according to the invention, namely the hammering down of a of a successive foil board $4_3$ . . . $4_n$.

Figure 1A:
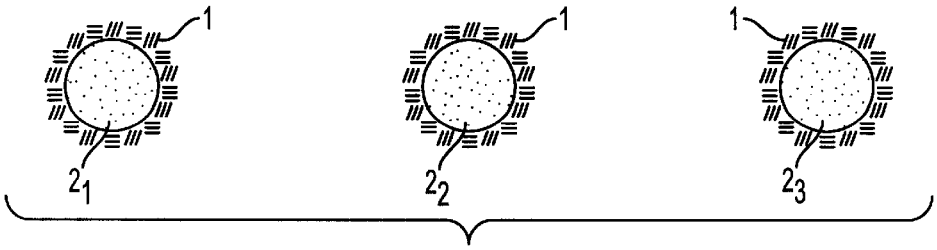
FIGS. 1.*a*–1.*e* show the successive main steps of the method according to the invention, FIGS. 2.*a*–2*b* show an armored concrete facet and bentonite type embodiment of the created cutoff according to the invention, FIG. 3. schematically shows the process of building the object, and FIGS. 4.*a*–4.*b* show a single driving pile according to the present invention in a perspective view and a bottom view, respectively.
Figure 1B:
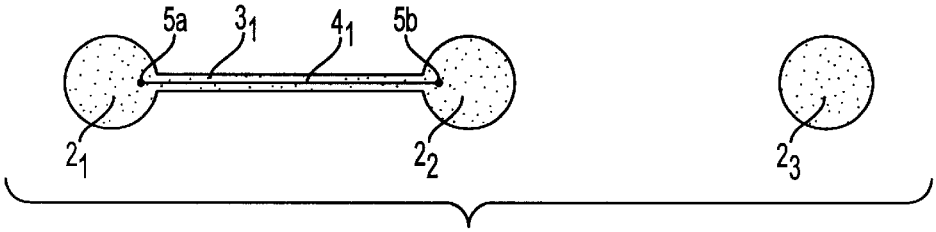
Figure 1C:
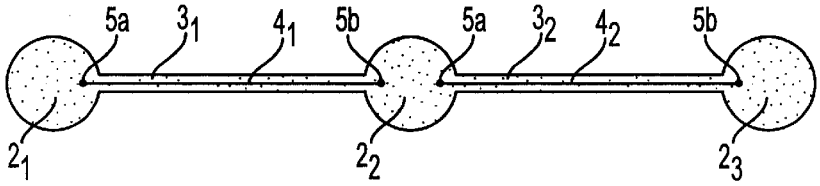
Figure 1D:
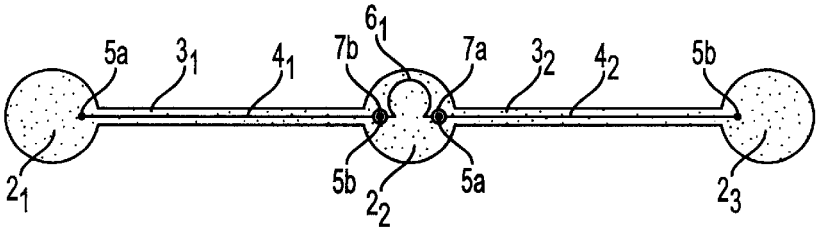
Figure 1E:
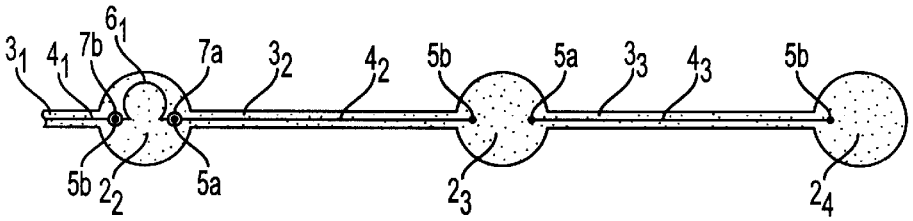
Figure 2A:
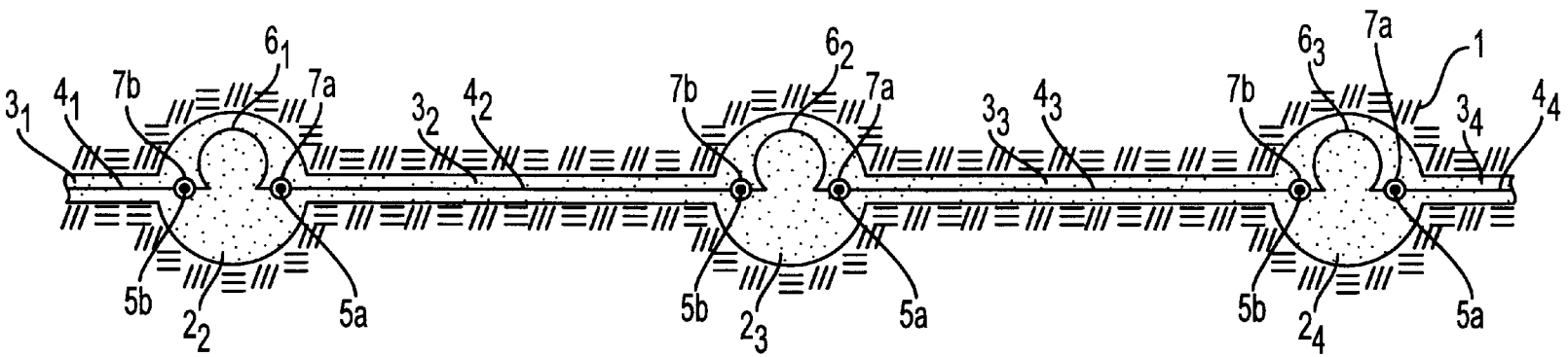
Figure 2B:
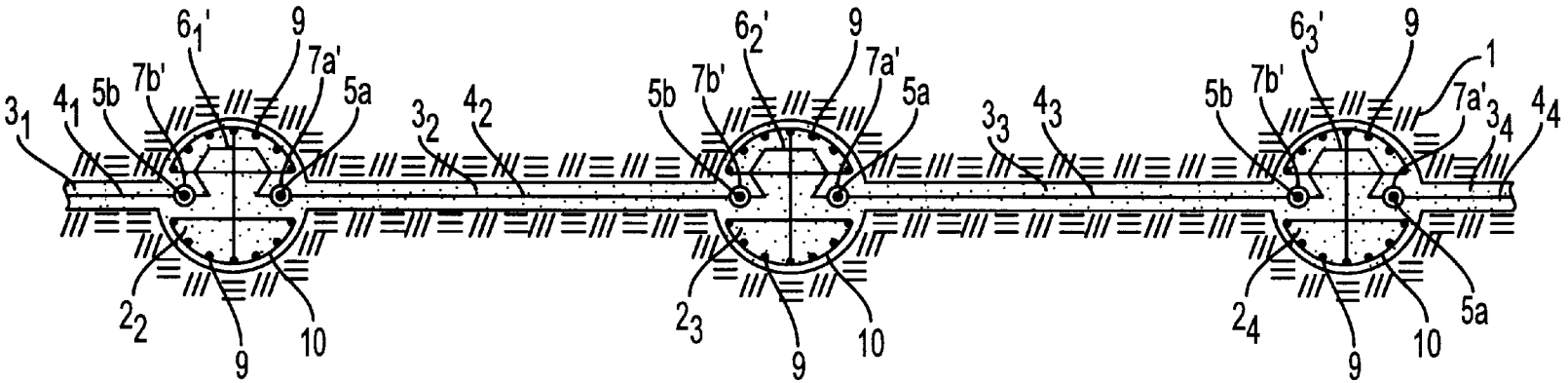

FIG. 2.*a* shows a top view of a section of a complete facet and bentonite type curtain-wall.

FIG. 2.*b* shows a further embodiment of the present invention, in which the facet comprise an armored concrete member.

In the case according to this embodiment, after completion of narrow gaps provided with foil boards $4_1$ . . . $4_n$, an armoring layer previously mounted on the surface will be placed into the borings $2_n$, . . . $2_{n+1}$ filled with tixothrope (bentonite) slush. In addition to the longitudinal armorings that are well known and conventionally used in the art, transversal bridles 10 connecting the armorings as mentioned previously, contain concrete steel bridles 10 having connecting members 7*a*',7*b*' on its opposite ends, and the bridles 10 attached to the connecting members 5*a*,5*b* being at the edges of each foil board $4_1$ . . . $4_n$ by means of connecting members 7*a*', 7*b*', form the compensating joint-pins $6_1$',$6_2$', . . . $6(_{n-1})_k$'.

The insertion of armoring may be followed by filling concrete into the borings $2_1$,$2_2$,$2_3$, . . . $2_{n+1}$ by means of an injection displacing the slush, and can be executable in the tixothrope material without any difficulty.

The advantage of this solution according to the invention is that, this operation (armoring and concreting) shall be executable, after completion of the cutoff, in a moment arbitrarily chosen, since the removing of the emplaced compensating joint-pins $6_1$', $6_2$', . . . $6(_{n-1})_k$' containing foil strips and changing to an armoring thereof, shall be allowed by the tixothrope material.

Figure 3:
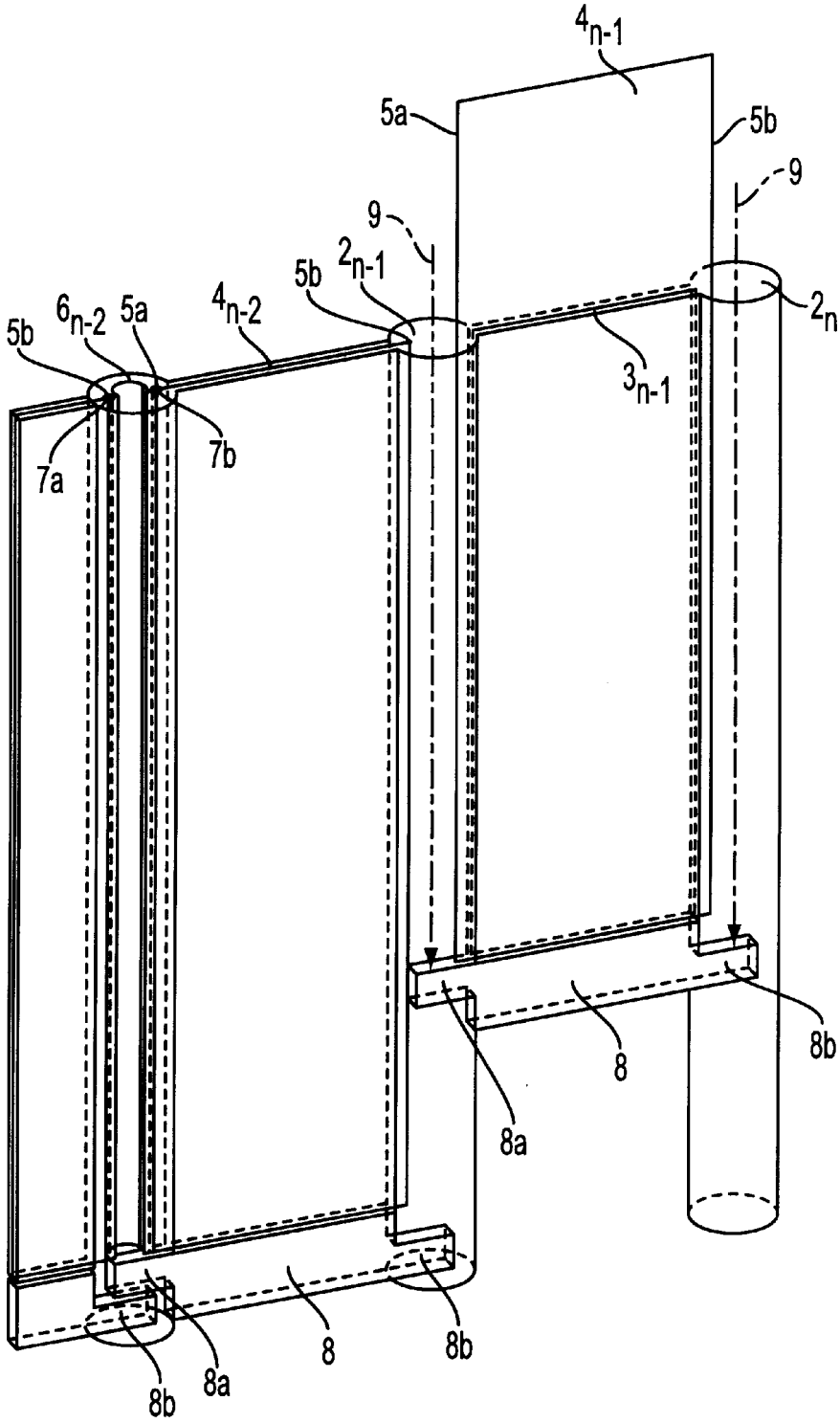

FIG. 3. shows an axial section of the structural arrangement of a facet and bentonite type curtain-wall being completed according to method of the invention. As shown in FIG. 3, when a foil board $4_{n-1}$ is being hammered down between the borings $2_{n-1}$, $2_n$, a cutting edge 8 attached to the bottom thereof, intersects the inner space of the borings $2_1$, $2_{n+1}$, and forms the narrow gap $3_{n-1}$.

Force lines 9 indicated by dash-dot lines in the FIG. 3. symbolize the applied driving piles 12 exerting a force onto the ends 8*a*,8*b* of the cutting edge 8. In the FIG. 3., there is shown only a theoretical arrangement, in that the practically applied cutting edges 8 have some striking plates with a gradually increasing cross-section advantageously to obtain the minimal resistance and to eliminate the dowel effect.

The ends 8*a*,8*b* of the cutting edges 8 remaining in the soil 1 are formed to seat and fit together with the adjacent ends 8*a*,8*b* of cutting edge 8 of foil boards $4_1$ . . . $4_n$ hammered down into the same depth.

The theoretical arrangement of the FIG. 3. is drawn to scale compared to a practically completed cutoff. Applying foil boards $4_1$ . . . $4_n$ having a few mm of thickness, the distance of borings $2_1$,$2_{n+1}$ lies on the order of a meter, while the order of diameter of borings $2_1$, $2_{n+1}$ must be chosen depending on the depth of the cutoff to obtain a buckling less than the permissible value.

Figure 4A:
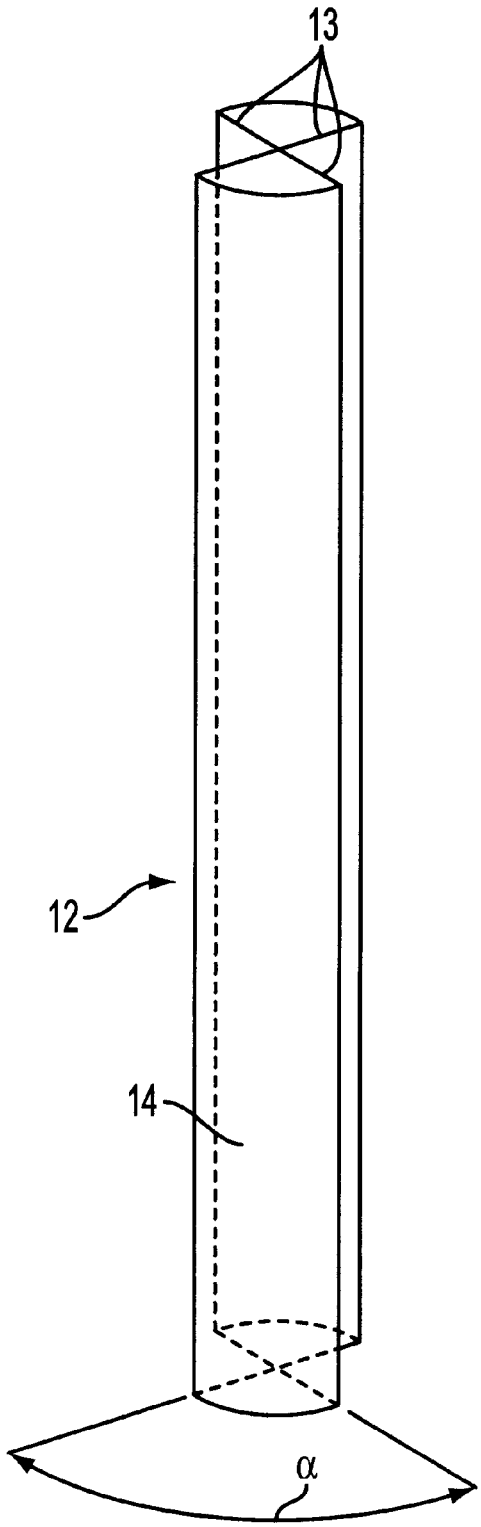

FIGS. 4.*a* and 4*b* show the theoretical arrangement of the driving pile 12 applied to realize the method according to the invention.

In this case, the inner ribs 13 of the driving pile are formed by steel sheets radially extending into the centreline and forming an angle a between them, the cross-ribs 14 of the driving pile 12 are also steel sheets incurvated to follow the shape of borings $2_1$,$2_2$,$2_3$, . . . $2_{n+1}$, and connect two inner ribs 13 forming an angle a therebetween.

Figure 4B:
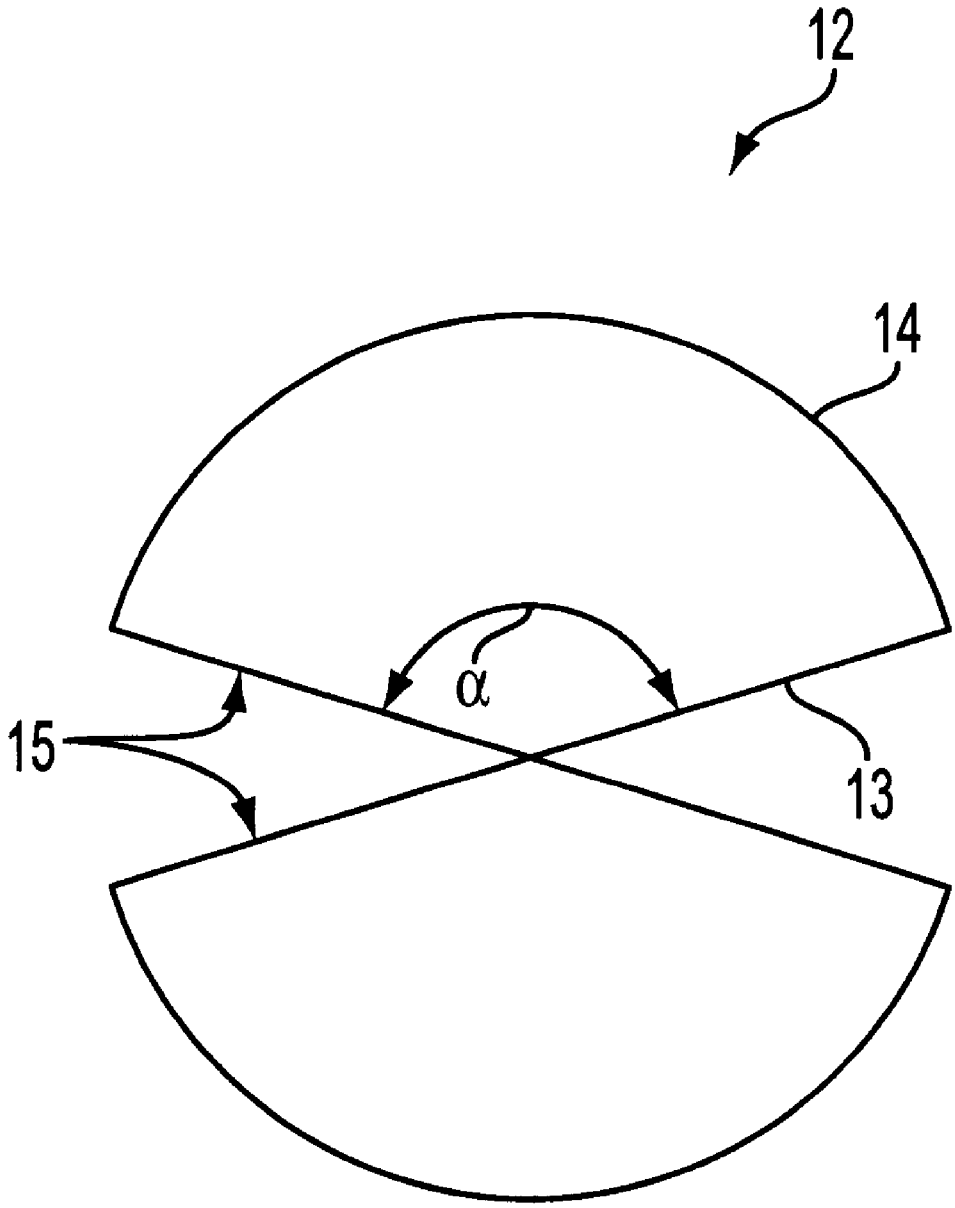

The bottom end of the inner ribs 13 comprise an adequately large face 15 (as shown in FIG. 4*b*) being adjacent the centreline of the driving pile 12 to seat reliably to the end 8*a*,8*b* of the cutting edge 8 and to transmit the force.

Summarizing the described method in a few words, the advantages of the solution of the present invention inhere in that, that the compaction of the side wall of the gap and the hammering down of the water-proof curtain-wall take place at the same time (contemporaneously) to obtain a narrow cutoff formed by means of driving technology and without soil 1 excavation, and so that the longitudinally acting friction force shall be negligibly small compared to the sliding resistance of the cutting edge 8. In this way 20–30 m deep, water-proof cutoffs may be built.

Compensating joint-pins $6_1$ . . . $6_{n-1}$ placed into borings $2_1$, . . . $2_{n+1}$ filled with tixothrope slush—bentonite suspension—go by the occasional bias of the curtain walls, and accommodate also the dimensional deviations due to the bias of borings $2_1$, . . . $2_{n+1}$.

This factors allow to create an excellent water-proof, load-bearing and economically advantageous cutoff.

I claim:

1. A method to build a continuous, water seal, creep-line increasing cutoff comprising the steps of:

drilling borings in soil at spaced-apart distances along a desired length of a cutoff wall;

driving down a first foil board into the soil between adjacent drilled borings in the presence of slurry to a desired depth by means of hammering a driving pile in each of the adjacent drilled borings and repeating the driving step so that the first foil board and an adjacent foil board are recessed in the soil according to the length of the cutoff wall, wherein each foil board has a connecting member on each side and a cutting edge secured onto the bottom of each foil board that protrudes over an edge of each board, and a driving pile is placed onto each side of the foil board; and connecting the side of the first, recessed foil board and the side of the adjacent, recessed foil board in the space of an intermediate drilled boring with a compensating joint-pin wherein the cutting edge has two ends, one on either side of the foil board, where one end is recessed from one side of the cutting edge and the other end is offset from the other side of the cutting edge, and the steps of drilling borings, driving down of an adjacent foil board step and connecting a first, adjacent recessed foil board to a second, adjacent foil board with compensating joint pins are repeated along the full length of the cutoff wall.

2. The method according to claim 1, wherein, above the surface of the soil, the two driving piles are rigidly connected to one another and are hammered down simultaneously.

3. The method according to claim 1, wherein the foil boards are made from High Density Polyethylene (HDPE) material.

4. The method according to claim 1, wherein the compensating joint-pins connecting the recessed foil boards are foil strips made of the same material as the recessed foil boards, and the compensating joint-pins have connecting members which create a form-fitting connection with a connecting member of a foil board.

5. The method according to claim 1, further comprising the step of placing an armoring into the drilled borings, wherein the compensating joint-pins include bridles provided with connecting members.

6. The method according to claim 5, wherein the step of armoring occurs after recessing the foil boards and a volume of concrete is injected into the drilled borings displacing the slurry.

7. The method according to claim 1, wherein the driving piles include inner ribs of longitudinally extending linear sheets that cross each other at the center line of the driving pile thereby forming quadrants and cross-ribs formed of sheets that extends from one outer end of an inner rib to an outer end of a second inner rib thereby closing two opposite quadrants of the driving pile, and wherein the driving pile has a face formed by ends of the inner ribs.

8. The method according to claim 7, wherein the driving pile comprises a number of sections that are detachably joined to one another.

9. The method according to claim 7, wherein the inner ribs of the driving pile are made from hollowed sheets that are incurvated to arc at their edges.

10. The method according to claim 1, wherein the two ends of the cutting edge are a recessed area and an offset "L"-shaped extension and the "L"-shaped extension of the first, recessed foil board connects with the recessed area end of the adjacent, recessed foil board.

* * * * *